United States Patent [19]

Trosky et al.

[11] Patent Number: 4,867,034

[45] Date of Patent: Sep. 19, 1989

[54] METHOD AND ARRANGEMENT FOR THE MARKING OF TARGET OBJECTS

[75] Inventors: Bernhard Trosky, Lauf; Clemens Wolfschmitt, Memmelsdorf, both of Fed. Rep. of Germany

[73] Assignee: Diehl GmbH & Co., Nuremberg, Fed. Rep. of Germany

[21] Appl. No.: 154,971

[22] Filed: Feb. 11, 1988

[30] Foreign Application Priority Data

Feb. 20, 1987 [DE] Fed. Rep. of Germany ..... 3705383

[51] Int. Cl.[4] ..... F41G 9/00; F42B 13/36

[52] U.S. Cl. ..... 89/1.11; 102/513; 244/3.15

[58] Field of Search ..... 244/3.15, 3.16, 3.19; 102/384, 393, 513; 89/1.11

[56] References Cited

U.S. PATENT DOCUMENTS

| | | | |
|---|---|---|---|
| 3,695,555 | 10/1972 | Chadwick | 244/3.16 |
| 4,178,851 | 12/1979 | Brady | 102/393 |
| 4,179,088 | 12/1979 | French | 244/3.19 |
| 4,281,809 | 8/1981 | Oglesby et al. | 244/3.16 |
| 4,347,996 | 8/1982 | Grosso | 244/3.16 |
| 4,433,626 | 2/1984 | Landstrom | 102/390 |
| 4,448,106 | 5/1984 | Knapp | 89/1.11 |

FOREIGN PATENT DOCUMENTS

| | | |
|---|---|---|
| 2714688 | 10/1977 | Fed. Rep. of Germany . |
| 3047678 | 9/1981 | Fed. Rep. of Germany . |
| 2029943 | 3/1980 | United Kingdom . |

*Primary Examiner*—Charles T. Jordan

*Attorney, Agent, or Firm*—Scully, Scott, Murphy & Presser

[57] ABSTRACT

A method for the marking of target objects against which guided projectiles or missiles are to be homed, and to an arrangement for the marking of target objects against which guided projectiles or missiles are to be homed. Target objects are marked through the application of radiators, which can be scattered over a target area through the use of carrier projectiles; for example, over an area within which there has been determined a collection of targets. Individual targets can then, without necessitating the technological demands for evaluating a target signature, be easily found by guided projectiles or missiles possessing target seeking devices which are directionally oriented towards the radiation energy of the marker, and homed thereon precisely targeted even when the target objects are already dispersed in a looser formation over a larger area.

7 Claims, 1 Drawing Sheet

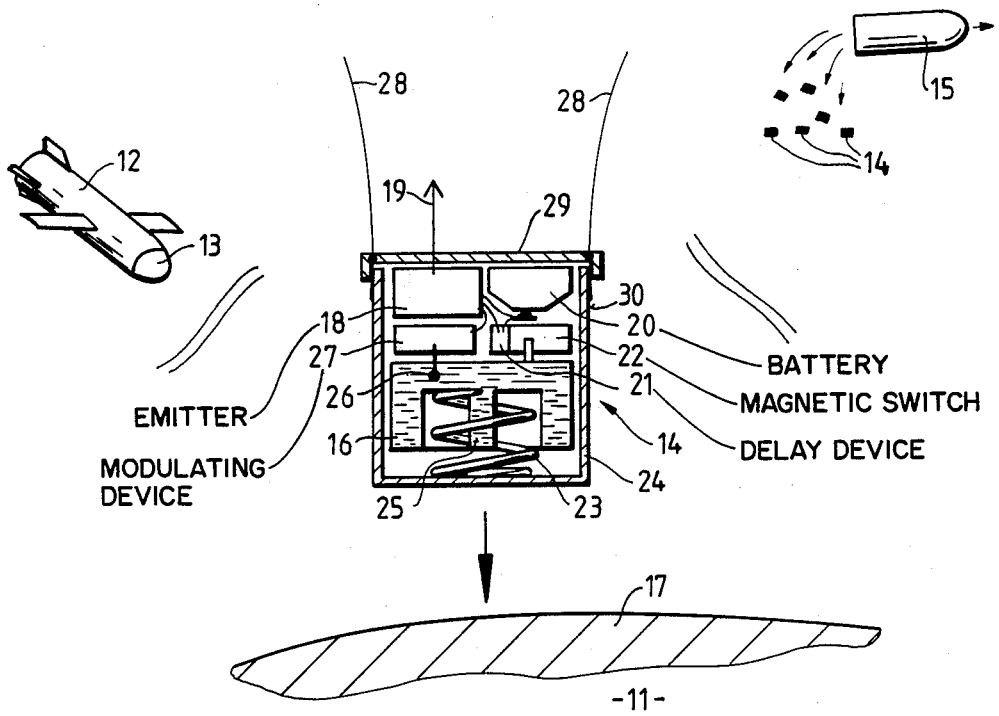
28
28
15
14
12
13
19
29
30
18
20
27
22
BATTERY
26
21
MAGNETIC SWITCH
EMITTER
16
14
DELAY DEVICE
MODULATING DEVICE
24
25
23
17

METHOD AND ARRANGEMENT FOR THE MARKING OF TARGET OBJECTS

BACKGROUND OF THE INVENTION

1. Field of the Invention

The present invention relates to a method for the marking of target objects against which guided projectiles or missiles are to be homed. Moreover, the invention relates to an arrangement for the marking of target objects against which guided projectiles or missiles are to be homed.

2. Discussion of the Prior Art

Measures in conformance with the foregoing are known, for example, from the disclosure of U.S. Pat. No. 4,347,996, from U.S. Pat. No. 3,695,555 or from German Laid-Open Patent application. 27 14 688, as so-called semi-active target-seeking guidance systems. In this system, usually with the aid of a forwardly located observer, there is effectuated a marking of the target through illumination or through the intermediary of a directional source of radiation energy, preferably through the utilization of a laser beam. The energy which is reflected from the selected target object is received by the target seeking or searching device of a guided projectile or missile which, in every instance, is autonomously guided during the final phase of flight, and is utilized for directional guidance; in effect, for an attack against this target object. Whereas the tactical advantage of this semi-active target-seeking guidance system is to be able to mark certain arbitrarily or randomly selected target objects and to thereby be able to attack these objects, it is nevertheless encumbered with the quite significant disadvantage that the advanced or forwardly-positioned observer can be easily detected by an enemy, and thereby rapidly placed out of action. As a consequence thereof, the autonomously intelligent ammunition has won increasing interest in that it can be effectively employed against collections of targets as subammunition which is equipped with a search fuze, whereas for more widely fanned-out or dispersed target scenario, it is necessary to employ trajectory-corrected or even trajectory-guided projectiles or missiles which are equipped with search heads.

SUMMARY OF THE INVENTION

Accordingly, the invention is based on the recognition that because of the enormous technological demands on self-sufficient intelligent ammunition (with sensor triggering or even influence over the trajectory) it would be of considerable interest to be capable of providing an essentially less expensive semi-autonomous system, which is also predicated on the attacking of hard or armored targets which need not be detected on the basis of their inherent radiation or other signatures, but which can be acquired with essentially less demand on the basis of an externally implemented marking of the target.

In recognition of these conditions, it is accordingly an object of the present invention to facilitate a semi-autonomous attacking of hard targets without necessitating the utilization of a forwardly-positioned observer for this purpose.

The foregoing object is inventively attained in that the method for the marking of target objects of the type under consideration herein contemplates the scattering of marking radiators which are activated upon their adherence to target objects.

Furthermore, there is also employed an inventive arrangement for the marking of the target objects, which is in the form of a marking radiator which is ejectable over a target object, and which is equipped with an emitter adapted to be activated upon adherence to a target object.

The foregoing method and arrangement, in view of the inherent high risk to the observer, foregoes the entirely individual selection of a certain target object which is to be attacked. Instead thereof, target objects are marked through the application of radiators, which can be scattered over a target area through the use of carrier projectiles; for example, over an area within which there has been determined a collection of targets; for instance, such as a marching column prior to the fanning out thereof into a battle formation. Thereby, the probability is extremely high that most of the target objects of interest can have at least one target marker placed thereon; so that the individual targets can then, without necessitating the technological demands for evaluating a target signature, be easily found by guided projectiles or missiles possessing target seeking devices which are directionally oriented towards the radiation energy of the marker, and homed thereon in a precisely targeted manner even when the target objects are already dispersed in a looser or scattered formation over a larger area.

The covering of the target objects with target markers is preferably effected by means of magnetically adherent devices which, during their response; in effect, after impinging against steel surfaces on the respective target object, will, for example, radiate thermal or electromagnetic energy (in conformance with the mode of operation of the target-seeking device of the guided projectile or missile).

As the adherent media for the marking radiators there are preferably provided magnets, inasmuch as the target objects, as a rule, are objects which are armored through the intermediary of ferromagnetic materials, especially objects such as armored vehicles. When a larger number of marking radiators are strewn or scattered over the target objects, the probability is then extremely high that a plurality of marking radiators will remain adherent to a single target object. Hereby, there can then be expected a dense concentration of radiators at those locations at which there are present the heaviest or greatest masses of ferromagnetic material, whereas at less operationally-critical or important locations on the target object which, for example, merely carry sheetmetal coverings, in all probability, fewer making radiators will remain adherent. This has indicated itself to be expedient to the extent that inasmuch as the highest radiation intensity is located in the better armored but extremely operationally-important regions of the target object, and thereby the oncoming guided projectile will be homed onto this preferred attacking location. Instead thereof, or in addition thereto, it can also be contemplated to modulate the radiation intensity (for example, to switch over between two intensity steps or levels); namely, in dependence upon the region of adherence to the target object, which is readily classifiable by the mass and thereby by the armoring constituted from the ferromagnetic material; which can again be detected through a magnetic-field probe; in essence, through the intensity of the flux of the magnetic circuit which is closed upon adherence.

BRIEF DESCRIPTION OF THE DRAWING

Additional alternative and modifications, as well as further features and advantages of the invention can now be ascertained from the following detailed description of a preferred embodiment of the invention, taken in conjunction with the accompanying single FIG. of drawing illustrating the deployment of marking devices over a target area; as well as showing one such device in an axial longitudinal sectional view, and the targeted homing against a marked target through the utilization of a target-seeking guided projectile or missile.

DETAILED DESCRIPTION

A target object 11 is to be attacked through the utilization of a guided projectile or missile 12, which is equipped with a target-seeking or search device 13 for the final flight-phase guidance for automatically homing onto the target. The target-seeking device 13 can be designed, for example, so as to be able to respond to thermal energy which is radiated from the target object 11, or to laser-radiation energy reflected from the target object 11. Pursuant to the present invention, it is contemplated that as a source for energy radiation to which the target-seeking device 13 will respond, a marking radiator 14 is to be applied on the target object 11. A larger number of such marking radiators 14 are scattered over the area within which there is suspected or there has been ascertained the presence of at least one target object 11. The deployment of the radiators 14 above the target object is preferably carried out in the type of deploying submunition; in effect, through the ejection of a package of radiators 14 from a carrier projectile 15. The latter preferably possesses the same caliber as the guided missile or projectile 12 which is to be subsequently started or launched, such that the same launching installation and essentially the same flying orientation can be employed in succession for the marking and for the attacking of a target object 11.

Inasmuch as target objects 11 which are of interest in connection with the foregoing are so-called hard targets; in essence, targets which are armored with ferromagnetic materials, especially such as combat vehicles, each marking radiator 14 is equipped with a magnet 16, by means of which the radiator 14 will adhere to a ferromagnetic surface 17 on the target object 11. Under marching or combat conditions, the crew of the target object 11 or the accompanying troops are practically unable to detect the relatively small radiator 14 on the large surface 17 of the target and to again remove the radiator; inasmuch as for a dense strewing or scattering of radiators 14 which are deployed over the target area, a number thereof can adhere to quite different locations on a target object 11. In order to be able to deploy the largest possible number of radiators 14 by means of a carrier projectile 15 above the target area, the individual cup-like radiators are cylindrically-compressed or short in shape, such that through a correlation of the caliber of an axial stack of radiators 14, it is possible to fully utilize the internal space of the carrier projectile 15.

When a marking radiator 14 adheres to the target surface 17, there is in this instance activated a so-called emitter 18. The latter, in accordance with the contemplated target-seeking device 13, can pertain to a pyrotechnic composition for the emission of thermal radiation energy or to a high-frequency transmitter with an antenna 19 for the irradiation of electromagnetic energy, for example, within the millimeter-wave frequency range. The activation, and respectively, operation of the emitter 18 is carried out by means of a battery 20 which is conveyed along within the radiator 14. Through the employment of a generally mechanical or electrical delay device 21 it is possible to ensure that the emitter 18 will only then be activated when the applicable marking radiator 14 actually, and for already a lengthier period, adheres to the target surface 17; as a result of which this will prevent a marking irradiator which has dropped onto the ground or which has again fallen off from the target object 11, from leading the guided projectile 12 into a position in which a target object which is to be attacked is not at all even present.

For the activation of the emitter 18 (in essence, the battery) there can be provided a magnetic field-controlled switch 22. As such, for this switch, in the illustrated representation, there is illustrated a mechanically-actuated switch 22 which is switched over by the holding or adherent magnet 16 when, because of the approach to the magnetic surface 17, the magnet has been displaced from its inoperative position provided by means of a coil spring 23, which is carried in a housing 24 for the marking radiator consisting of a non-ferromagnetic material, for example, of aluminum or plastic, into its activated position and thereby concurrently assumes the magnetic adherence to the target surface 17. In the interest of obtaining a high degree of a magnetically adhesive force, the magnet 16 is preferably constructed as a sintered pot-shaped magnet with a central post 25, which also facilitates for a compact construction with regard to the restraining coil spring 23.

In the illustrated exemplary embodiment, provision is additionally made that, by means of a magnetic probe 26, there can be evaluated the intensity of the magnetic flux. This flux is lower for non-activated holding magnets 16 than for a closed magnetic circuit which is closed through the ferromagnetic target object 11 with the forwardly displaced magnet 16. Moreover, the flux in the magnetic circuit is dependent upon the mass of the wall section; in effect, upon the mass of the ferromagnetic material below the target surface 17. When a plurality of marking radiators 14 adhere to a target object 11 possessing a larger surface, then the magnetic flux which can be determined by means of the probe 26, is also lower for magnetic radiators 14 which adhere to mere sheetmetal coverings, than would be the case for the adherence to solid or massive armored steel masses, such as on the turret or on the shell of an armored vehicle. Thus, when the magnetic probe 26 activates a modulating device 27, either continuously or in steps can there be influenced the intensity or any other characteristic of the energy irradiated from the emitter 18.

For example, as a result thereof, this achieves the guided projectile 12 to be homed onto that marking radiator 14 on an armored vehicle forming a target object 11, which radiates at a certain characteristic, in the simplest instance with high energy; such that there is avoided an irritation and deflection of the target-seeking device 13 by the radiators 14 which adhere to the target nearby this particular radiator 14 which is of primary interest, but which adhere only to surfaces which are less critical to the vulnerability of the target object 11, such as sheetmetal coverings.

Finally, in the drawings, there is also considered that it would be expedient to equip the marking radiators 14 with aerodynamic orientation devices 28 (for example, small braking parachutes attached at the tail end, flutter bands or fins). These devices are folded in the packed position into the carrier projectile 15 or on the tail end cover 29 of the radiator, or folded in or telescopingly-like conducted along the side wall 30 of the radiator in order to extend rearwards outwardly into the airflow during the free-fall of the deployed marking radiator 14, and to thereby ensure a guided descent with the holding magnets 16 oriented downwardly forward.

What is claimed is:

1. An arrangement for the marking of target objects against which guided projectiles are to be homed; comprising a marking radiator which is ejectable over a target object; and said radiator including an emitter which is activatable upon adherence to a target object, said radiator further including a holding magnet for adhering to said target object, and delay means for delaying the activation of said emitter.

2. An arrangement as claimed in claim 1, comprising modulating means for activating said emitter in dependence upon the intensity of adhesion of said radiator to the surface of the target object.

3. An arrangement as claimed in claim 1, comprising switch means for the release of the emitter, said switch means being responsive to an adhering means.

4. An arrangement as claimed in claim 1, comprising a holding magnet which is displaceable opposite the force of a restraining spring.

5. An arrangement as claimed in claim 1, comprising aerodynamically-brakable orienting means on said radiator.

6. An arrangement as claimed in claim 1, wherein said emitter delivers high-frequency electrical energy.,

7. An arrangement as claimed in claim 1, wherein said emitter comprises an active pyrotechnic composition.

* * * * *